US005463411A

United States Patent [19]

Wehl

[11] Patent Number: 5,463,411

[45] Date of Patent: Oct. 31, 1995

[54] ELECTROTHERMAL INK PRINT HEAD

[75] Inventor: Wolfgang Wehl, Berlin, Germany

[73] Assignee: Eastman Kodak Company, Rochester, N.Y.

[21] Appl. No.: 54,715

[22] Filed: Apr. 28, 1993

[30] Foreign Application Priority Data

Apr. 28, 1992 [DE] Germany ..... 42 14 556.2

[51] Int. Cl.[6] ..... B41J 2/05; B41J 2/175

[52] U.S. Cl. ..... 347/65; 347/87; 347/94

[58] Field of Search ..... 346/140; 347/63, 347/85, 65, 94

[56] References Cited

U.S. PATENT DOCUMENTS

| | | | |
|---|---|---|---|
| 4,158,847 | 6/1979 | Heinzl | 347/68 |
| 4,500,895 | 2/1985 | Buck | 347/63 X |
| 4,633,274 | 12/1986 | Matsuda | 347/86 |
| 4,791,440 | 12/1988 | Eldridge | 347/63 |
| 4,812,859 | 3/1989 | Chan | 347/63 |
| 4,914,562 | 4/1990 | Abe | 347/63 |
| 4,922,269 | 5/1990 | Ikeda | 347/58 |
| 4,929,969 | 5/1990 | Morris | 347/63 |
| 4,980,703 | 12/1990 | Sakurai | 347/63 |
| 4,999,650 | 3/1991 | Braun | 347/58 |

FOREIGN PATENT DOCUMENTS

| | | | |
|---|---|---|---|
| 91/17891 | 11/1991 | WIPO | B44J 2/05 |

*Primary Examiner*—Joseph W. Hartary

*Attorney, Agent, or Firm*—Cohen, Pontani, Lieberman & Pavane

[57] ABSTRACT

An improved electrothermal ink print head has a sandwich-type construction in which the propagating direction of the electrothermally-produced steam bubble is opposite to the direction of ink discharge onto a print medium or substrate. To improve efficiency and reduce the reciprocal influence of adjacent ink ducts, the side of the chip 11 facing the ink supply vessel 12 is provided with a cover plate 1. At the points of intersection of the ink ducts 16 and supply conduits 15, the cover plate 1 includes openings 2 whose cross-sectional extents or areas are predeterminately related to the intersecting ducts and conduits. In a first variation, the cover plate 1 is formed of glass or ceramic and is anodically bonded on the chip. In a second variation, the cover plate 1 is fabricated of a plastic foil that is laminated on the chip 11 and is adhesive on both its opposite surfaces. In a third variation, the cover plate 1 is formed of a metal foil that is anodically bonded to the chip 11.

6 Claims, 2 Drawing Sheets

ELECTROTHERMAL INK PRINT HEAD

FIELD OF THE INVENTION

The present invention is directed to an electrothermal ink print head having a sandwich-type construction in which the direction of propagation of an electrothermally-produced steam bubble is substantially opposite the ink discharge or ejection direction for impressing an image on a print substrate.

BACKGROUND OF THE INVENTION

Known electrothermal ink print heads—i.e. using the so-called bubble-jet principle—are typically provided with a plurality of individual jets or nozzles from which individual droplets of a defined or predetermined or controllable magnitude are generated under the command of an electronic control unit and are discharged or propelled or ejected or shot outward in an intended pattern in the direction of an image-receiving print medium or substrate or the like.

The lines of image or test characters to be printed are produced by a plurality of ink droplets that are arranged in rows and columns in the general form of a matrix.

In an advantageous manner, each of the columns of such a character-oriented matrix is printed serially one after another so as to provide and enable high printing speed and uniform type faces.

Thus, an ink print head suitable for the aforementioned printing process must combine a plurality of substantially identical elements capable of shooting out or ejecting ink droplets at selectively-controlled times, commonly known as "drop-on-demand" discharge. A characteristic feature of this technology conventionally consists in the provision of an electrically-connected resistor or the like forming a heating element and located in a capillary tube that is filled with recording liquid, as for example printing ink, in the vicinity of the capillary tube opening. When a predetermined thermal or heat energy is selectively supplied to this heating element by the application of a brief current pulse through the resistor, a rapidly expanding ink steam bubble is initially produced through an extremely rapid transfer of heat to the ink liquid. The bubble bursts relatively quickly after the supply of energy to the resistor terminates and the liquid ink cools. The pressure wave formed by the steam bubble in the interior of the capillary tube permits an ink drop of limited mass to propellingly exit from the nozzle opening onto the surface of a print medium or substrate located in appropriate proximity to the opening.

One advantage of the bubble-jet principle is that the relatively large and rapid change in volume necessary for propellingly discharging the ink droplets is obtained from a very small active converter surface area by utilizing the alternating liquid-gas-liquid phases of the liquid ink. The small converter surfaces, in turn, allow the ink print heads to be constructed in a relatively simple and inexpensive manner characterized by high printing track density and small dimensions using modern production methods such as high-precision photolithography processes in lamination or film technology.

An ink print head including a chip and an associated ink supply vessel is disclosed in International Patent Application PCT/DE 91/00364, in which construction the chip is mechanically locked onto or coupled to the ink supply vessel by mounting or assembly clamps. The chip includes ink ducts that are closed on three sides and open on the fourth and which are separated one from another by thin, substantially trapezoidal intermediate duct-walls. The closure of each respective ink duct in the ink shooting or discharge direction is formed by a thin diaphragm which, in turn, includes the discharge nozzle of the respective ink duct.

A surface of the ink supply vessel forms the external closure of the ink ducts along the fourth side which is open toward the chip. As the chip is held on the ink supply vessel by only the positively-locking assembly clamp, the intermediate duct-walls are movable on and relative to the surface of the ink supply vessel. This disadvantage is aggravated by a high length-to-thickness ratio of the intermediate duct-walls on the order of approximately 50:1 and a high height-to-thickness ratio of those duct-walls of approximately 10:1.

When an individual heating element of the print head is triggered for producing and discharging an ink droplet, the heating element, and the formation of a bubble, results in the creation of a localized overpressure in the respective ink duct. This overpressure condition leads not only to the intended ejection or discharge of the ink droplet but, in addition, to a bending or deformation or distortion of the intermediate duct-walls bounding the respective ink duct in the direction of the immediately-adjacent ink ducts. The effect is that, in addition to the amount of energy required for ejecting the droplet, there must be a further application of that so-called lost energy which results in deformation of the intermediate duct-walls. The need to supply this lost energy in the printing process necessarily reduces the overall operating efficiency of the ink print head.

Moreover, the deformation or bending of the intermediate duct-walls seriously affects the operation and status of immediately adjacent ink ducts. That is, when triggering an ink duct adjacent to an ink duct which is not being triggered, the latter may nevertheless unintendedly discharge a droplet as a result of the increased pressure in the intentionally-triggered duct.

Depending upon whether adjacent ink ducts are triggered, there is a change in the pressure ratios in the respective ink ducts and, accordingly, in the resulting mass of the drop and the print quality.

OBJECTS AND SUMMARY OF THE INVENTION

It is, therefore, the desideratum of the present invention to provide an improved ink print head which overcomes these and other disadvantages of known print head constructions. It is a particular object of the invention to provide such an ink print head having a sandwich-type construction that may be readily and economically manufactured using currently-available materials and techniques, which exhibits improved efficiency, and which is suitable for operatively providing a consistent and high print quality without regard to the type of operation.

This and other objects of the invention are advantageously attained in a print head construction in which the chip is provided with a cooperating cover plate at and along its side that faces the ink supply vessel. The cover plate is secured to the chip along the entire available surface of the facing chip surface or side with specific reference to the edge regions of the chip and, more particularly, along the free front sides of the intermediate duct-walls. The intermediate duct-walls are accordingly securely clamped on all sides. The pressure wave resulting from activation of the heating elements in the ink ducts remains substantially confined to the respective ink duct from which an ink drop is to be discharged and is transformed to a higher degree than heretofore attainable into drop-propelling energy. This action substantially increases the efficiency of the ink-discharging ink duct on the one hand and, on the other, advantageously reduces the unintended influence and effect on immediately adjacent ink ducts. The dependence of the drop mass on the triggering of adjacent ink ducts is thereby notably and effectively minimized.

A further advantage of the present invention lies in the ability to accurately assume that the intended predetermined ink density is discharged, through the defined closure of the chip, in the direction of the ink supply vessel by the provision of the cover plate. The cover plate includes openings at the interfaces between the supply conduits in the ink supply vessel and the ink ducts in the chip. Recoil of the ink in the direction of the ink supply vessel, resulting from the pressure wave in the ink duct, is minimized in accordance with the dimensioning of these cover plate openings. This further increases operating efficiency and reduces the reciprocal influence of adjacently-disposed ink ducts in the operation of the inventive print head.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein like reference numerals denote similar elements through the several views.

DETAILED DESCRIPTION OF THE PREFERRED EMBODIMENTS

Figure 1:
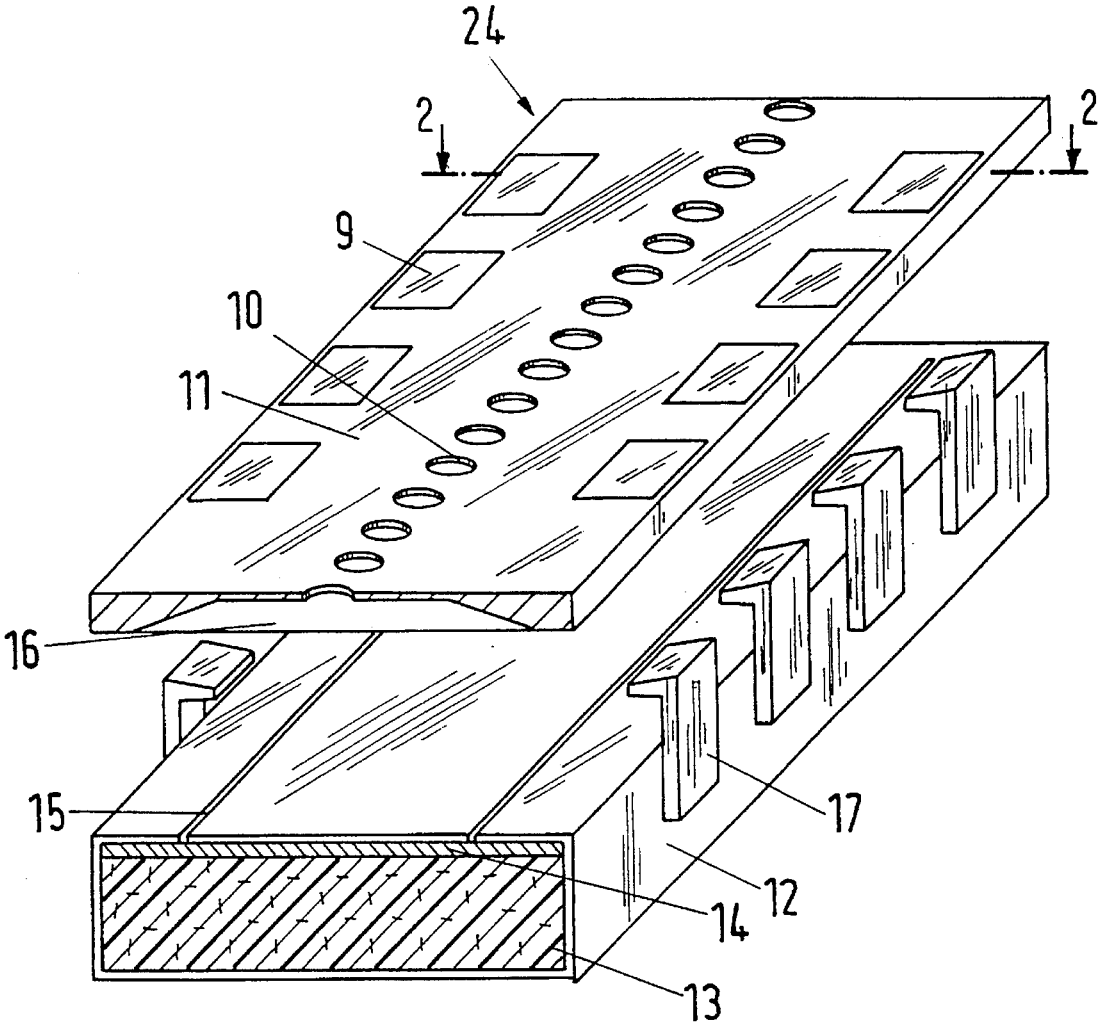
Fig.1 PRIOR ART
FIG. 1 is an elevated perspective view of the separated pans of an ink print head to which the present invention may be applied.

FIG. 1 illustrates the construction of an ink print head to which the improvement of the present invention may be applied. The print head includes substantially only two parts to be connected to one another to form the print head—namely a chip 11 containing the heating elements, electric leads and contacts for forming the electrical connection, as well as the ink ejection or discharge openings or nozzles, and an ink supply vessel 12 to which the chip 11 is detachably fastened or coupled while serving as a cover for the vessel 12. The heating elements (not shown in this elementary drawing), the electric leads, the contacts 9 and the discharge openings 10 may be fabricated in a single chip 11, as for example of the preferred material silicon, using known planar processing steps or the like.

The ink supply vessel 12 has a generally rectangular configuration within which is received or inserted a medium, such as a sponge 13, saturated with liquid ink. Outlet openings in the form of two ink supply conduits 15 that communicate with filters 14 are defined in and along the top or upper surface or side of the ink supply vessel 12 in facing relation to the chip 11. These supply conduits 15 extend in substantially parallel relation to one another in the longitudinal direction or elongation of the rectangular ink supply vessel 12 so that, when the chip 11 is coupled to the vessel 12, a flow connection or path is established between the supply conduits 15 and the discharge openings 10 via ink ducts 16 defined in the underside of the chip 11. The coupled mounting of the chip 11 on the ink supply vessel 12 is effected in a relatively simple manner through a plurality of assembly clamps 17 that are arranged along the longitudinal side walls of the ink supply vessel 12 and which serve for both mechanically connecting the two and completing electrical contact with the contacts 9.

Figure 2:
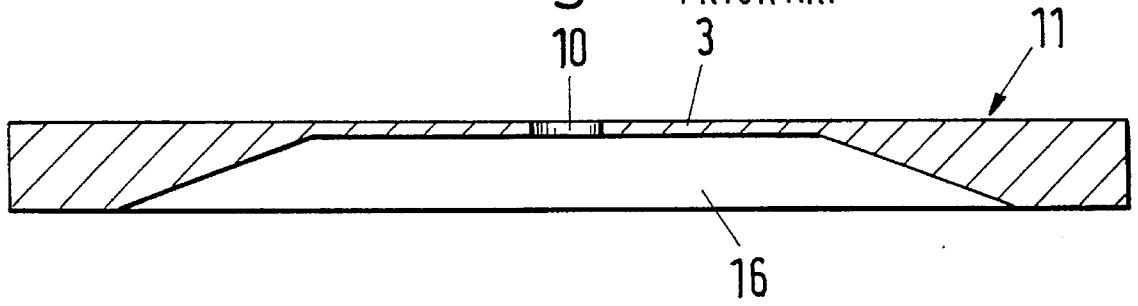
Fig. 2 PRIOR ART
FIG. 2 is a cross-sectional view through the chip of the ink print head of FIG. 1, taken along the lines 2—2 in FIG. 1.

FIG. 2 shows a cross-sectional view through the chip 11 along the section lines II—II in FIG. 1. In this figure may particularly be seen the geometrical shape or configuration of an ink duct 16 having substantially parallel walls and sloped or angled run-off end zones. As is also indicated in FIG. 2, the ink duct 16 is closed by a diaphragm 3 on the side of the nozzle only by means of a relatively thin film of the chip substrate material, the discharge openings 10 being provided or defined in the diaphragm 3. The resistive heating elements 4 are arranged on the chip 11 on the side of the diaphragm 3 remote from the ink duct 16, the general location of such heating elements in accordance with the invention being indicated by the general reference numeral 4 in FIG. 3.

Figure 3A:
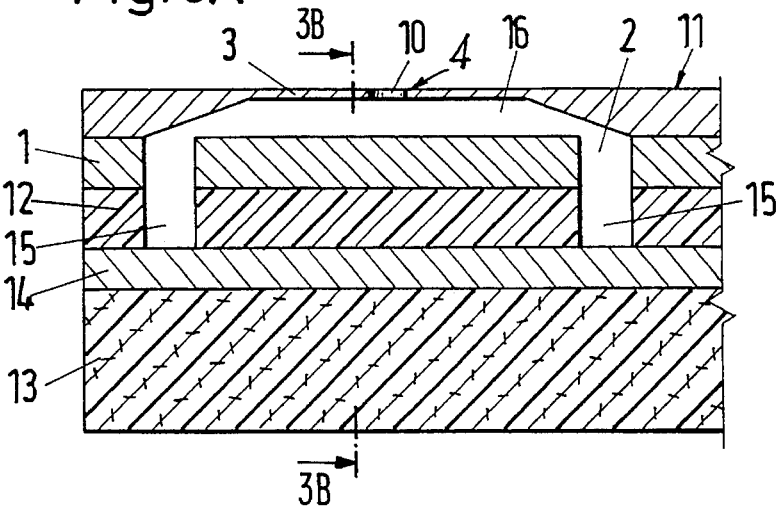
FIG. 3A is a cross-sectional view through an ink print head constructed in accordance with the present invention.
Figure 3B:
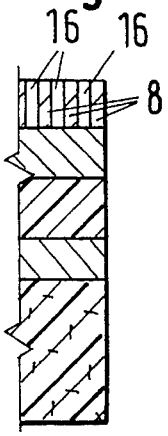
FIG. 3B is a cross-sectional view taken along the lines 3—3 in FIG. 3A.

In accordance with the present invention as depicted in FIG. 3A, the chip 11 is further provided with a cover plate 1 at its side facing the ink supply vessel 12 and which, in the assembled condition of the print head, is sandwiched between the chip 11 and vessel 12. The cover plate 1 includes a pair of elongated openings or slits 2 which are located at the intersections of the chip ink ducts 16 and vessel supply conduits 15. Intermediate duct-walls 6 (FIG. 3B) boundingly separate immediately-adjacent ink ducts 16. In this first embodiment of the inventive print head, the cross-sectional area or extent of each of the openings 2 is of substantially the same dimensional extent and configuration as the interface which results from the intersection of the respective ink duct 16 and supply duct 15.

As seen in FIG. 1, the ink ducts 16 have in longitudinal section a generally trapezoidal shape and are adjoined by the supply conduits 15 at the acute angles or end tips of the trapezoid. Consequently, the pressure wave generated or released by an ink steam bubble as a result of the activation of the heating elements 4 initially surrounds the outlet opening 10 and subsequently spreads out or propagates in the direction of the supply conduits 15 which are situated at a further distance therefrom. When the pressure wave reaches the supply conduits 15, a recoil effect is triggered whereby the ink from the ducts 16 is pressed back into the supply conduits 15. The ink is then drawn into the ink ducts 16 once again as a result of capillary action in the ink ducts only after the pressure wave subsides.

Figure 4A:
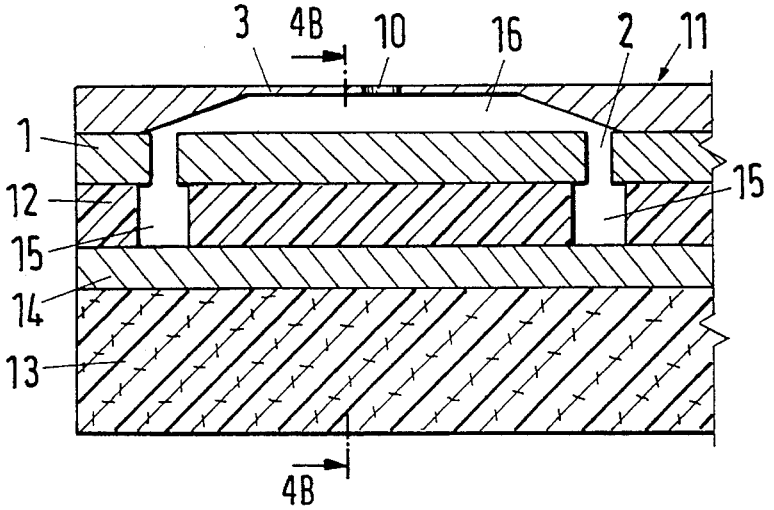
FIG. 4A is a cross-sectional view through an ink print head similar to FIG. 3 but in which the through-openings are reduced in cross-sectional size.
Figure 4B:
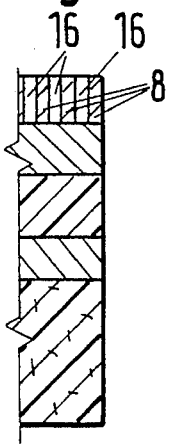
FIG. 4B is a cross-sectional view taken along the lines 4B—4B in FIG. 4A.

In a further and alternate or modified form of the inventive print head, the cross-sectional extent or area of the openings 2 in the cover plate 1, as shown in FIG. 4A, is reduced with respect to the interface of the respective ink duct 16 and supply conduit 15. As a result of this modified construction, the above-described recoil effect is reduced such that the amount of ink flowing back in the direction of the supply conduits 15 is notably limited. Aside from those advantages already described—i.e. a reduced reciprocal influence of the ink ducts, improved efficiency, and reduced dependence of the drop mass on the triggering of adjacent ink ducts—an additional advantageous effect of this modification lies in that the restoration time of the triggered ink duct 16 is notably shortened, permitting retriggering of the same ink duct for a subsequent discharge of an ink droplet that much sooner. This enables a higher ink discharge frequency and, consequently, a higher printing speed.

Figure 5:
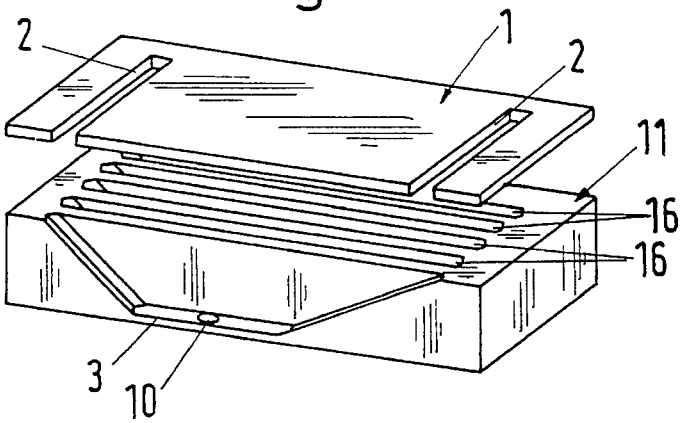
FIG. 5 is an elevated perspective exploded view of the chip and cover plate of a print head of the invention.

FIG. 5 depicts the cover plate 1 of the invention relative to and before being mounted on the chip 11. The cover plate 1 has a pair of substantially parallel, elongated openings 2 which overlap the edge regions of the ink ducts 16 in the chip 11. The ink ducts 16 are closed in the ink discharge or firing direction by the diaphragm 3 which, as noted above, includes the outlet opening 10.

In a first variation, the cover plate 1 may be fabricated from glass, silicon or ceramic and anodically bonded to the chip 11. In a second variation, the cover plate 1 is formed of a plastic foil that is laminated on the chip 11. In a third variation, the cover plate 1 is likewise formed of a plastic foil but, in this case, is adhesive on both or opposite sides or faces. The tightness of the interface seam or seal between the chip 11 and the supply vessel 12 against the flow or seepage of ink is reinforced particularly effectively in this third variation. In still a fourth variation, the cover plate 1 is fabricated from a metallic foil that is anodically bonded to the chip 11.

The exact processing sequence will depend on the material and connection methods utilized. The openings 2 are subsequently etched or structured by means of a laser, or may be sand-blasted or precision stamped for precise positioning relative to the ink ducts 16.

The aforedescribed variations and modifications may be applied to each of the embodiment forms herein disclosed as general matters of design choice.

Thus, while there have been shown and described and pointed out fundamental novel features of the invention as applied to preferred embodiments thereof, it will be understood that various omissions and substitutions and changes in the form and details of the disclosed devices may be made by those skilled in the art without departing from the spirit of the invention. It is the intention, therefore, to be limited only as indicated by the scope of the claims appended hereto.

What is claimed is:

1. An electrothermal ink print head, comprising:

a chip integrally including an ink discharge opening through which droplets of ink are operatively discharged in a discharge direction onto a print medium upon which an image is to be impressed, an elongated ink duct for delivering ink to said discharge opening, and a heating element disposed on said chip remote from said ink duct and operable for electrothermally heating ink in said ink duct for forming an electrothermally-produced steam bubble that propagates in a direction opposite said discharge direction;

a cover plate having at least one elongate opening defined therethrough, said at least one elongate opening being perpendicular to said ink duct and located to correspond with a respective end of said ink duct; and an ink supply vessel for storing a supply of ink and including a supply conduit located to correspond with said at least one elongate opening for delivering ink from said vessel to said chip ink duct via said at least one elongate opening;

said chip, cover plate and vessel being connected together so that said cover plate is sandwiched between said chip and said ink supply vessel and so that said at least one elongate opening is aligned with said supply conduit so as to define a continuous flow path formed of said supply circuit, said at least one opening and said ink duct such that ink is operatively delivered from said supply vessel supply conduit to said chip ink duct through said at least one cover plate opening, said at least one elongate opening being of a width less than the width of said supply conduit to thereby reduce recoil effects on ink within said ink duct created by the pressure wave.

2. An electrothermal ink print head in accordance with claim 1, wherein said supply conduit and said ink duct define a first cross-sectional size at their respective intersections with said opening and wherein said opening has a second cross-sectional size smaller than said first cross-sectional size.

3. An electrothermal ink print head in accordance with claim 1, wherein one of said supply conduit and said ink duct defines a first cross-sectional size at its intersection with said opening and wherein said opening has a second cross-sectional size smaller than said first cross-sectional size.

4. An electrothermal ink print head in accordance with claim 1, wherein said cover plate is formed from one of glass, ceramic, silicon and metal, and wherein said cover plate is anodically bonded to said chip.

5. An electrothermal ink print head in accordance with claim 1, wherein said cover plate is formed of a plastic foil, and wherein said cover plate is laminated on said chip.

6. An electrothermal ink print head in accordance with claim 5, wherein said plastic foil has opposed adhesive surfaces.

* * * * *